United States Patent [19]

Noguchi et al.

[11] Patent Number: 4,648,373

[45] Date of Patent: Mar. 10, 1987

[54] INTAKE MANIFOLD FOR INTERNAL COMBUSTION ENGINE HAVING EXHAUST GAS RECIRCULATION SYSTEM

[75] Inventors: Yoshikazu Noguchi, Okazaki; Tatsuhisa Yokoi, Toyota; Eisaku Takeya, Aichi; Hideyuki Osawa, Obu, all of Japan

[73] Assignees: Toyota Jidosha Kabushiki Kaisha, Toyota; Kabushiki Kaisha Toyoda Jidoshokki Seisakusho, Kariya, both of Japan

[21] Appl. No.: 766,783

[22] Filed: Aug. 19, 1985

[30] Foreign Application Priority Data

Sep. 29, 1984 [JP] Japan ..... 59-147735[U]

[51] Int. Cl.[4] ..... F02M 25/06

[52] U.S. Cl. ..... 123/568; 123/569; 123/52 M

[58] Field of Search ..... 123/52 M, 568, 569, 123/570, 571, 572, 573

[56] References Cited

U.S. PATENT DOCUMENTS

| | | | |
|---|---|---|---|
| 3,680,534 | 8/1972 | Chavant | 123/568 |
| 3,730,156 | 5/1973 | Sarto | 123/568 |
| 4,119,071 | 10/1978 | Hattori | 123/568 |
| 4,364,369 | 12/1982 | Nomura et al. | 123/569 |

FOREIGN PATENT DOCUMENTS

| | | |
|---|---|---|
| 0088933 | 7/1981 | Japan . |
| 0088934 | 7/1981 | Japan . |
| 0033713 | 3/1983 | Japan . |
| 0065922 | 4/1983 | Japan . |
| 0116748 | 8/1983 | Japan . |

*Primary Examiner*—Willis R. Wolfe, Jr.

*Attorney, Agent, or Firm*—Cushman, Darby & Cushman

[57] ABSTRACT

An intake manifold (2) for an internal combustion engine equipped with an exhaust gas recirculation (EGR) system for recirculating a part of the exhaust gas to the intake system, having a V-shaped rib (13) formed on the inner surface thereof with the vertex (13*a*) directed upstream with respect to the flow of the intake air. The V-shaped rib is positioned upstream of the EGR gas outlet (10) of the EGR system so that oil contained in blow-by gas supplied by a positive crankcase ventilation (PCV) system or charged-air supplied by a turbocharger into the intake manifold (2) does not flow into the EGR gas outlet (10), but flows away from the EGR gas outlet (10). Therefore, the deposition of sludge around the EGR gas outlet (10) is prevented and a sufficient EGR rate is secured.

3 Claims, 4 Drawing Figures

INTAKE MANIFOLD FOR INTERNAL COMBUSTION ENGINE HAVING EXHAUST GAS RECIRCULATION SYSTEM

BACKGROUND OF THE INVENTION

1. Field of the Invention

The present invention relates to an internal combustion engine equipped with an exhaust gas recirculation (EGR) system. More specifically, it relates to an intake manifold of such an internal combustion engine, for preventing the deposition of combustion products around the EGR gas outlet.

2. Description of the Related Art

In an ordinary internal combustion engine, unburnt hydrocarbons (abbreviated to "HC" hereinafter) leak through the clearances between the piston and the piston rings into the crankcase of the engine due to a so-called pumping action of the piston rings during reciprocating operation, of the piston. The discharge of HC (generally referred to as "the blow-by gas") into the atmosphere causes air pollution. Therefore, it is usual to feed the blow-by gas through the cylinder head into the intake manifold, where the blow-by gas mixes with the intake air or fuel-air mixture. Such a system for introducing the blow-by gas into the intake manifold is generally referred to as a positive crankcase ventilation system (abbreviated to "PCV system" hereinafter).

On the other hand, in some internal combustion engines, before discharging the exhaust gas into the atmosphere, a part of the exhaust gas (EGR gas) is circulated through the intake system, to reduce the concentration of nitrogen oxides (abbreviated to "NOx" hereinafter) in the discharged exhaust gas. In such an exhaust gas recirculation system, especially for a Diesel engine, EGR gas contains relatively large amount of combustion products, such as carbon particles. On the other hand, in a PCV system as mentioned above, oil vapor contained in the blow-by gas is brought from the crankcase through the cylinder head and head cover into the intake manifold in which the oil flows in a mist or film-like condition. Under these circumstances, the carbon particles contained in the EGR gas are trapped by the oil flowing from the PCV system into the intake manifold and adhered to the inner surface of the intake manifold. These particles, hereinafter referred to as "deposits," grow in the vicinity of the EGR pipe (the EGR gas inlet of the intake manifold), thereby these deposits may block the outlet of the EGR pipe. In an engine equipped with a turbocharger, some of the bearing lubrication oil in a turbin housing will leak to the intake manifold, so that the amount of oil flowing therein is increased, thereby the above-mentioned problems will readily arise.

Techniques have been proposed to reduce the collection of deposits around the outlet of the EGR pipe. Such known techniques are, for example; projecting the outlet of an EGR pipe into the interior of an intake manifold (Japanese Unexamined Utility Model Publication Nos. 56-88933 and 58-116748); disposing the outlet of an EGR pipe and the outlet of the pipe of a PCV system symmetrically with respect to the center axis of the throttle valve (Japanese Unexamined Patent Publication No. 58-65922); providing a blow-by gas guide for guiding the blow-by gas to a point downstream of the outlet of the EGR pipe (Japanese Unexamined Utility Model Publication No. 56-88934); or projecting a blow-by gas pipe of a PCV system into the interior of an intake manifold (Japanese Utility Model Publication No. 58-33713).

SUMMARY OF THE INVENTION

An object of the present invention is to provide an intake manifold having simple construction for an internal combustion engine equipped with an EGR system, the interior of the manifold being provided with a means for preventing the oil vapor and the like from flowing into the exhaust (EGR) gas outlet of the EGR pipe, thereby preventing the deposition of deposits around the exhaust gas outlet to secure a necessary exhaust gas recirculating rate (abbreviated to "EGR rate" hereinafter).

According to the present invention, an intake manifold for an internal combustion engine, equipped with an EGR system for recirculating a part of the exhaust gas from an exhaust passage through an exhaust (EGR) gas outlet into the intake manifold, has a rib or weir for preventing the flow of oil from entering the EGR gas outlet, formed on the inner surface thereof at a position upstream of the EGR gas outlet. The rib or weir is formed in a V-shape with the vertex thereof directed upstream of the manifold and the angle at the vertex of the V-shape is preferably in the range of 30° to 90°. Preferably, the height and the width of the rib or weir are both in the range of 4 mm to 5 mm and the ratio of the sectional area of the rib or weir to that of the fluid passage of the main pipe portion of the intake manifold is 5% or less.

DESCRIPTION OF THE PREFERRED EMBODIMENT

Figure 4:
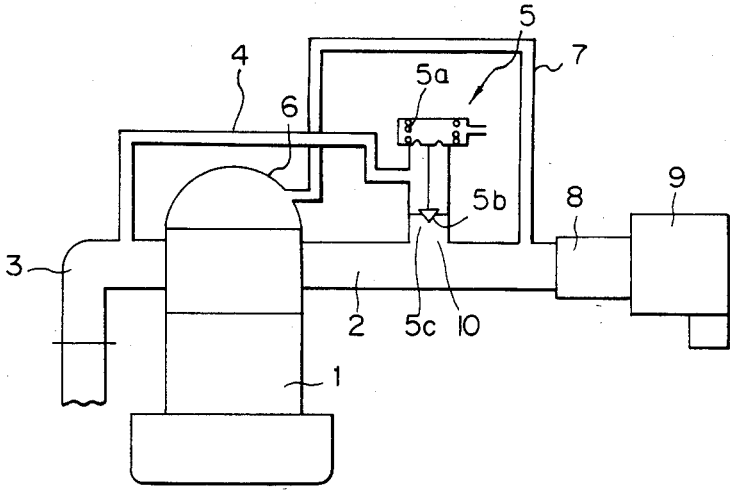
Fig.4 (PRIOR ART)

The present invention will be described hereinafter with reference to a preferred embodiment thereof in conjunction with the accompanying drawings. First, referring to FIG. 4, indicated at 1 is an internal combustion engine; 2, an intake manifold; and 3, an exhaust manifold. The intake manifold 2 and the exhaust manifold 3 are connected to each other by means of an exhaust gas recirculation pipe 4 (abbreviated to "EGR pipe" hereinafter) and an exhaust gas recirculation valve 5 (abbreviated to "EGR valve" hereinafter). The valve element **5*b* of the EGR valve 5 is operated to open or close an inlet 5*c* by the mutual functions of the intake manifold pressure and the resilent force of a spring 5*a*. A part of the exhaust gas (EGR gas) is recirculated or fed through an EGR gas outlet 10 into the intake manifold 2. The intake manifold 2 is connected to the interior of a cylinder head cover 6 by means of a positive crankcase ventilation pipe (abbreviated to "PVC pipe" hereinafter) 7 which opens into the intake manifold 2 at a position upstream of the EGR gas outlet 10. An air cleaner 9** is connected to the intake manifold 2 by a hose 8. Such an engine including EGR and PCV systems in already known in the prior art.

Figure 1:
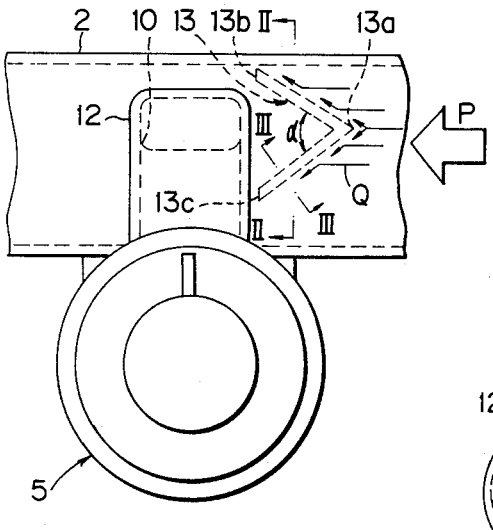
FIG. 1 is a fragmentary top view of a part of a main pipe portion of the intake manifold of the present invention, around the EGR gas outlet, as mounted on the vehicle.
Figure 2:
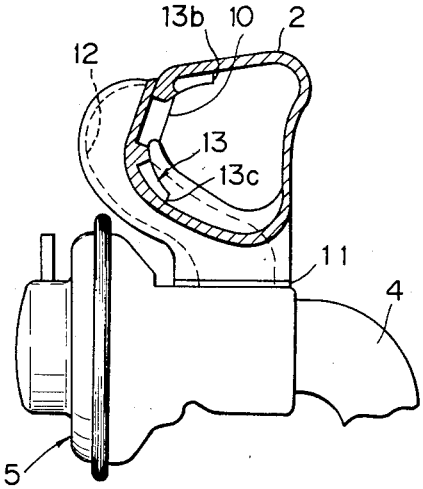
FIG. 2 is a cross-sectional view taken along line II—II of FIG. 1.
Figure 3:
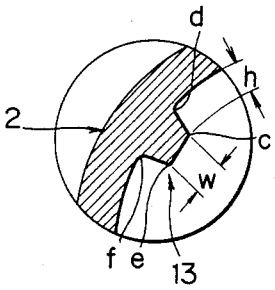
FIG. 3 is an enlarged cross-sectional view taken along line III—III in FIG. 1; and, FIG. 4 is a schematic illustration generally showing an internal combustion engine equipped with an EGR system.

FIG. 1 is a fragmentary top view of a part of a main pipe of the intake manifold of the present invention, around the EGR gas outlet, as mounted on the vehicle. FIG. 2 is a cross-sectional view taken along line II—II of FIG. 1. FIG. 3 is an enlarged cross-sectional view taken along line III—III in FIG. 1. The EGR valve 5 is attached through a gasket 11 to the intake manifold 2. An EGR gas outlet section 12 of the EGR valve 5 is buried slightly in the upper wall of the intake manifold 2 so that the EGR gas outlet 10 is opened to the interior of the intake manifold 2 at the upper side thereof, where the least amount of oil flows in the intake manifold 2. A V-shaped rib or weir 13 is formed on the upper inner surface of the intake manifold 2 at a position on the upstream side of the EGR gas outlet 10. The vertex 13*a* of the V-shaped rib 13 is directed upstream of the intake manifold 2, and is on a straight line passing through the EGR gas outlet 10, the upstream side of the EGR gas outlet 10. A pair of Legs 13*b* and 13*c* of the V-shaped rib 13 obliquely entended, with respect to the direction P of the flow of intake air to positions near the opposite sides of the EGR gas outlet 10, respectively, which positions are slightly above and below, respectively, the EGR gas outlet 10, as shown in FIG. 1. These end positions of the legs 13*b* and 13*c* are seen as being located on the right-hand side of the EGR gas outlet 10 in FIG. 2. As shown in FIG. 2, the extremity of the leg 13*b*, in particular, terminates at a position relatively lower than the EGR gas outlet 10. The legs 13*b* and 13*c* each extend to a position immediately before the EGR gas outlet 10 with respect to the direction P of the flow of the intake air.

Preferably, the angle of the V-shape of the rib 13 is in the range of 30° to 90°, as shown in FIG. 1. The height (h) and the width (w) of the rib legs 13*b* and 13*c* are both about 4 to 5 mm, as shown in FIG. 3. It is also preferable that the ratio of the sectional area of each of the rib legs 13*b* and 13*c* to the sectional area of the fluid passage of the main pipe portion of the intake manifold 2 is 5% or less. As shown in FIG. 3, the edges c and the roots d of the legs 13*b* and 13*c* facing outside the V-shape or upstream in the intake manifold 2 are both rounded at a radius of curvature of 1 mm or less so that the oil flowing downstream along the inner surface of the intake manifold 2 is unable to flow easily over the V-shaped rib 13. On the other hand, the edges e and the roots f of the legs 13*b* and 13*c* facing downstream in the intake manifold 2 are both rounded at a radius of curvature of 3 mm or more so that a dead zone will not be formed behind the legs 13*b* and 13*c* and oil or water mist contained in the intake air will not stagnate behind the legs 13*b* and 13*c*.

In FIG. 1, the intake air that flows in the intake manifold 2 in the direction indicated by the arrow P contains oil flow like a film state, introduced into the intake manifold 2 through the PCV pipe 7 (FIG. 4) and/or oil which will be leaked from a turbin housing into the intake manifold 2, in case of an engine equipped with a turbocharger, not shown in the drawings. Since the specific gravity of oil is greater than that of air, oil has a tendency to flow along the inner surface of the intake manifold 2. However, because the EGR gas outlet 10 is located in the upper wall of the intake manifold 2, it is comparatively hard for oil to flow into the EGR gas outlet 10. Thus, if the oil approaches the EGR gas outlet 10, it is guided by the outer sides of the V-shaped rib 13 to flow outside the EGR gas outlet 10 as indicated by arrows Q, and thereby the oil is caused to flow downstream in the intake manifold 2 without flowing into the EGR gas outlet 10. On the other hand, while the EGR valve 5 is open, the EGR gas is introduced through the EGR gas outlet 10 into the intake manifold 2. The EGR gas introduced into the intake manifold 2 first is mixed with the intake air, and then, after having been mixed uniformly with the intake air, flows together with the above-mentioned oil. Accordingly, sludge will not be deposited in the vicinity of the EGR gas outlet 10.

As mentioned above, according to the present invention, in an internal combustion engine equipped with an EGR system, the EGR gas introduced into the intake manifold flows together with the oil contained in the blow-by gas introduced into the intake manifold and the oil leaked into the intake manifold from the turbocharger, after having been well mixed with the intake air. Therefore, sludge including carbon particles and impurities is neither produced nor deposited within the intake manifold, especially in the vicinity of EGR gas outlet 10, and hence a sufficient rate of EGR gas can be introduced into the intake manifold 2 through the EGR pipe 4. Furthermore, the V-shaped rib 13 of the present invention scarcely influences the flow of intake air in the intake manifold 2 and there is no possibility of the V-shaped rib 13 reducing the air suction efficiency of the internal combustion engine.

We claim:

1. An intake manifold for an internal combustion engine equipped with an exhaust gas recirculation system for introducing a part of the exhaust from an exhaust gas passage through an EGR pipe into an intake manifold, said intake manifold being provided with an EGR gas outlet port opened thereto and connected to said EGR pipe, and said intake manifold being provided with a rib formed on and extending along an inner wall of said intake manifold at a position upstream of said EGR gas outlet, in such a manner that said rib is obliquely extended with respect to an air flow direction so as to guide oil flowing downward along said inner wall away from said EGR gas outlet port.

2. An intake manifold according to claim 1, wherein the rib is extended in a V-shape with a vertex thereof directed upstream of the intake manifold, and an angle at the vertex of the V-shape is in the range of 30° to 90°.

3. An intake manifold according to claim 2, wherein the height and the width of the rib, in a cross-section perpendicular to the longitudinal direction thereof, are both in a range of 4 mm to 5 mm, and the ratio of the sectional area of the rib or weir to that of a fluid passage of a main pipe of the intake manifold is 5% or less.

* * * * *